United States Patent [19]

Schäfer

[11] 4,422,466

[45] Dec. 27, 1983

[54] ARRANGEMENT FOR CLEANING CONTAINERS OF DIVERSE SHAPES

[75] Inventor: Klaus Schäfer, Wuppertal, Fed. Rep. of Germany

[73] Assignee: Schicker & Schäfer, Wuppertal, Fed. Rep. of Germany

[21] Appl. No.: 374,608

[22] Filed: Apr. 30, 1982

[30] Foreign Application Priority Data

Aug. 7, 1981 [DE] Fed. Rep. of Germany ..... 3131333

[51] Int. Cl.[3] ..... B08B 3/02; B08B 9/08

[52] U.S. Cl. ..... 134/55; 134/170

[58] Field of Search ..... 134/44, 54, 55, 166 R, 134/169 R, 170, 171

[56] References Cited

U.S. PATENT DOCUMENTS

| | | | |
|---|---|---|---|
| 132,603 | 10/1872 | Rove | 134/166 R |
| 386,256 | 7/1888 | McQuaide | 134/44 X |
| 1,023,630 | 4/1912 | Elkins | 134/44 |
| 3,838,473 | 10/1974 | Remih | 134/55 X |

FOREIGN PATENT DOCUMENTS

| | | | |
|---|---|---|---|
| 414810 | 7/1947 | Italy | 134/170 |
| 603397 | 4/1960 | Italy | 134/55 |

*Primary Examiner*—Robert L. Bleutge
*Attorney, Agent, or Firm*—Michael J. Striker

[57] ABSTRACT

An arrangement for cleaning containers includes a spraying nozzle which is constructed as a pressure sprayer, and at least two jet tubes which are arranged at opposite sides of the spraying nozzle, extending substantially parallel to the axis of the latter. The spraying nozzle and the jet tubes are mounted on a common distributor body which, in turn is mounted on a base plate. The distributor body has a tubular configuration and carries at its end remote from the base plate a seat for a valve ball. The distributor body further includes an arrangement for conducting the cleaning water back along itself to the upstream ends of the jet tubes. As a result of this construction, the arrangement has a relatively low height, and yet it is suited for use in cleaning drinking containers of various shapes, such as tumblers and stemware. The valve ball is operated by a valve tappet or operating member which is guided in a tubular guiding wall extending upwardly beyond the distributor member. The valve tappet may either be provided with external grooves, or with an internal passage and radial openings communicating therewith, for the flow of the cleaning water therethrough from the valve seat of the ball valve to the spray openings of the spraying nozzle. The spraying nozzle sprays the cleaning water against the internal surface of the respective container, and the jet tubes against the external surface thereof.

14 Claims, 8 Drawing Figures

ARRANGEMENT FOR CLEANING CONTAINERS OF DIVERSE SHAPES

BACKGROUND OF THE INVENTION

The present invention relates to an arrangement for cleaning containers in general, and more particularly to an arrangement of this type which is especially suited for use in cleaning drinking utensils of diverse shapes, such as tumblers and stemware.

The conventional arrangements for cleaning drinking utensils are usually constructed as two-stage cleaning arrangements including a pre-cleaning device and a final cleaning device. One construction of such previously proposed cleaning arrangement is disclosed in the German utility model patent DE-GM 75 23 176. In this construction, the pre-cleaning device and the final cleaning device are mounted on a common base plate or bridge which is equipped with suction cups, by means of which the combination cleaning apparatus can be attached to the bottom wall of a sink, usually in a bar or a similar establishment in which the volume of drinking utensils to be cleaned within a given period of time warrants the use of such apparatus.

The pre-cleaning device of this cleaning apparatus includes a cup or bowl shaped receptacle which carries at its inner surface a plurality of cleaning or scrubbing bristles which extend substantially radially inwardly toward a centrally located inner cleaning brush. The final cleaning device is arranged next to the pre-cleaning device and includes a centrally situated spraying assembly which is constructed as a pressure sprayer and operative for cleaning the internal surface of the respective container, and at least two jet tubes which are arranged substantially in parallel to the axis of the container being cleaned and are provided with a plurality of jet openings or nozzles which are in use aimed at the external surface of the container being cleaned for cleaning such surface. The central spraying assembly and the jet tubes extend in parallel to one another and to a predetermined direction, usually an upward direction, from a common support which includes a valve and distributor body.

Given the usual application of the cleaning apparatus of the above construction, it is usually constructed for use in cleaning, that is, scrubbing and rinsing, conventionally configurated beer glasses. The central spraying assembly which is constructed as a pressure sprayer has such a height that even if the relatively tall beer glasses which are sometimes used to serve certain kinds of beers, such as barley malts, are to be cleaned in this apparatus, they will not abut the base plate of the apparatus with their then downwardly situated rim portion. However, should it be attempted to use this apparatus and especially the final cleaning device thereof for cleaning stemware, such as beer glasses with stems as used for serving pilsner beer or wine glasses which also have stems, then the stem-shaped foot of the respective stemware container or utensil remains above the spraying range of the laterally arranged jet tubes and, consequently, is not subjected to the final cleaning or rinse. This can only be achieved in the conventional construction of the final cleaning device by making the central spraying assembly provided with the pressure sprayer so short or low that even the stem or foot of the stemware container moves into the spraying range of the laterally arranged jet tubes. However, this solution has the disadvantage that, when it is intended to use the so constructed final cleaning device also for cleaning relatively tall glasses and similar containers, in addition to stemware, the bottom wall of such a tall glass never reaches a position in which it depresses a valve tappet that controls the valve member controlling the admission of the pressurized cleaning liquid to the spraying assembly and to the lateral jet tubes. Hence, it was heretofore customary to use either extremely high final cleaning devices which are hardly suited for use in actual practice, for cleaning both the tall glasses or tumblers and the stemware containers, or different final cleaning devices for cleaning the tumblers, on the one hand, and the stemware containers, on the other hand, wherein the final cleaning device for the normal glasses or tumblers had a central spraying assembly extending to a considerable height into the space between the lateral jet tubes, while the final cleaning device for the stemware containers had a relatively short central spraying arrangement. It will be appreciated that both of these approaches result in an increased expense and available space requirements and reduced practicality and hence consumer appeal of the cleaning arrangement.

SUMMARY OF THE INVENTION

Accordingly, it is a general object of the present invention to avoid the disadvantages of the prior art.

More particularly, it is an object of the invention to provide a cleaning arrangement for drinking utensils, which does not possess the disadvantages of the conventional cleaning arrangements of this type.

Still another object of the present invention is to so construct the arrangement of the above type as to be capable of use for cleaning both the tumbler-type and the stemware-type containers with equal ease and without modification.

It is yet another object of the present invention to so design the cleaning arrangement as to be capable of cleaning even the foot portions of the stemware containers at their external surfaces.

A concomitant object of the invention is to develop a cleaning arrangement of the type here under consideration which is simple in construction, inexpensive to manufacture, easy to use, and reliable in operation nevertheless.

In pursuance of these objects and others which will become apparent hereafter, one feature of the present invention resides in an arrangement for cleaning containers, especially drinking utensils of diverse shapes, such as tumblers and stemware, which comprises a support; means for spraying cleaning liquid on the internal surface of the respective container assuming a predetermined position relative to the support, including an elongated spraying assembly mounted on the support and having an internal distributing passage spaced in a predetermined direction from the support, and means for controlledly admitting the cleaning liquid at a predetermined pressure into the distributing passage, including a valve seat situated within the spraying assembly immediately upstream of the distributing passage, and a valve member movable toward and away from the valve seat; and means for directing a plurality of jets of the cleaning liquid against the external surface of the container assuming its predetermined relative position, including at least one tubular element extending substantially parallel to the aforementioned direction at a transverse spacing from the spraying assembly and having a plurality of jet openings aimed toward the spraying assembly, and means for conducting a portion of the cleaning liquid from the distributing passage substantially oppositely to the aforementioned direction to an upstream portion of the tubular element.

As a result of the fact that the spraying assembly, which is constructed as a pressure sprayer, is provided with the valve seat at a location relatively remote from the support and with the conducting or diverting means which diverts the flow of a portion of the cleaning liquid from the distributing passage back along the spraying assembly opposite to the aforementioned direction to the connecting location for the upstream portion of the tubular jet element, there is obtained the advantage that only a single final cleaning or rinsing device is needed for performing the final cleaning operation on regular glasses or tumblers and on stemware glasses or similar containers. The valve member, the extent of permissible stroke of which beyond the position in which it first admits the cleaning liquid at the desired pressure and flow rate at least corresponds to the usual height of the foot of the customary pilsner and/or wine glasses, renders it possible to adapt the operation of the cleaning arrangement to all kinds of glasses or similar containers customarily used in restaurants, bars or other establishments catering to the public, without requiring any structural modification of the final cleaning device in accordance with the type of glassware to be cleaned. Hence, this particular construction renders it possible to always move the container to be cleaned in the respective position, especially with respect to the externally effective tubular jet elements, in which the best cleaning results are obtained, regardless of the particular shape of the respective container. In addition thereto, however, there is obtained, despite the relatively long stroke of the valve member, a compact construction of the final cleaning device, so that neither the base plate, nor the more remote parts of the final cleaning device, lie farther from the bottom wall of the sink in which the cleaning apparatus is installed than in the conventionally constructed cleaning apparatus.

An advantageous construction of the cleaning apparatus is obtained when the spraying assembly includes a tubular guiding member mounted on and extending in the aforementioned direction from the support, when the valve seat is arranged within the guiding member at a location remote from the support, when the valve member is accommodated in the guiding member for movement in and opposite to the aforementioned direction, and when the controlledly admitting means further includes a valve tappet mounted in the spraying assembly for movement in and opposite to the aforementioned direction and operatively connected to the valve member for moving the latter at least away from the valve seat. The valve member may advantageously have a substantially spherical configuration.

The conducting means may advantageously include means for bounding an annular space surrounding the guiding member at the support and communicating with the upstream end of the tubular element. This construction is particularly advantageous when more than one of the tubular elements is used, such tubular elements being distributed around the periphery of the container assuming the predetermined relative position thereof, since uniform distribution of the cleaning liquid to all tubular elements is thereby assured. It is advantageous when the bounding means includes an annular bounding wall having a substantially radially extending connecting nipple for the tubular element, or one such nipple for each of the tubular elements, at its trailing end as considered in the aforementioned direction.

According to a further advantageous facet of the present invention, the conducting means further includes a confining wall merging with and extending in the aforementioned direction from the bounding wall to surround a distributing space around a portion of the distributing passage, and a tubular guiding wall extending beyond the confining wall as considered in the aforementioned direction, the valve tappet being partially received and guided in the guiding wall. A particularly simple construction is obtained when the support includes a plate-shaped support portion, when the bounding wall includes a mounting portion constituting the trailing end and having the connecting nipple or nipples, a holding flange abutting the support portion, and an externally threaded portion extending in the aforementioned direction beyond the support portion, the bounding wall further including another portion integral with the confining wall and having an internal thread engaging the external thread of the mounting portion.

According to an advantageous aspect of the present invention, the valve tappet is elongated in the aformentioned direction and has a solid cross section at least at the region adjacent the valve member and at least one longitudinally extending groove for the passage of the cleaning liquid therethrough at least past the valve seat when the valve tappet holds the valve member away from the valve seat. Advantageously, the longitudinal groove has a cross section which gradually increases from the region of solid cross section adjoining the valve member. In this manner, the amount of liquid entering the distributing passage in a unit of time and its pressure can be controlled by controlling the extent and rate of depression of the valve tappet.

In the alternative, the valve tappet may be tubular and may be provided with a plurality of orifices for the passage of the cleaning liquid therethrough into the interior of the valve tappet, these orifices extending substantially radially and being distributed over the length of the valve tappet, so that the effective area for the passage of the cleaning liquid increases with increasing distance of the valve member from the valve seat as determined by the depression of the valve tappet.

In an advantageous construction according to the present invention, the valve tappet is received in the guiding wall with a radial clearance therefrom at least over a part of its periphery to form an annular clearance between itself and the guiding wall for the flow of the cleaning liquid therethrough toward the bottom of the respective container assuming its predetermined relative position.

When the valve tappet is tubular to form a flow passage for the cleaning liquid therethrough from a trailing end to a leading end of the valve tappet as considered in the aforementioned direction, the valve tappet is advantageously provided at its leading end with at least one aperture communicating with the flow passage and aimed at the container assuming its predetermined relative position, to form a spray directed against the latter.

According to another advantageous concept of the present invention, the valve member is constructed as a two-stage valve member. A particular advantage of this construction is that there can be obtained opening and closing of the valve member which is especially soft and free from sudden pressure changes and water hammer effects caused thereby in the supply conduits. An advantageous construction utilizing this concept involves the use, as a part of the controlledly admitting means, of a valve operating member which is mounted in the spray assembly for movement in and opposite to the aforementioned direction and which has a portion of a predetermined transverse cross section extending beyond the valve seat as considered opposite to the aforementioned direction. Then, the two-stage valve member includes a substantially spherical first valve element closer to the valve seat and having a central passage receiving the aforementioned portion of the valve operating member and having a transverse cross section exceeding that of the latter to form an annular flow passage therewith, and a substantially plate-shaped second valve element rigidly connected to the valve operating member for movement therewith and situated to the other side of the first valve element from the valve seat, the valve elements so cooperating with one another and with the valve seat that initially only the second valve element is lifted during an opening operation off the first valve element thus permitting the cleaning liquid to flow through the annular flow passage in the first valve element, followed by lifting of the first valve element off the valve seat only upon considerable movement of the valve operating member opposite to the aforementioned direction.

The novel features which are considered as characteristic of the invention are set forth in particular in the appended claims. The improved cleaning arrangement for drinking utensils itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1:
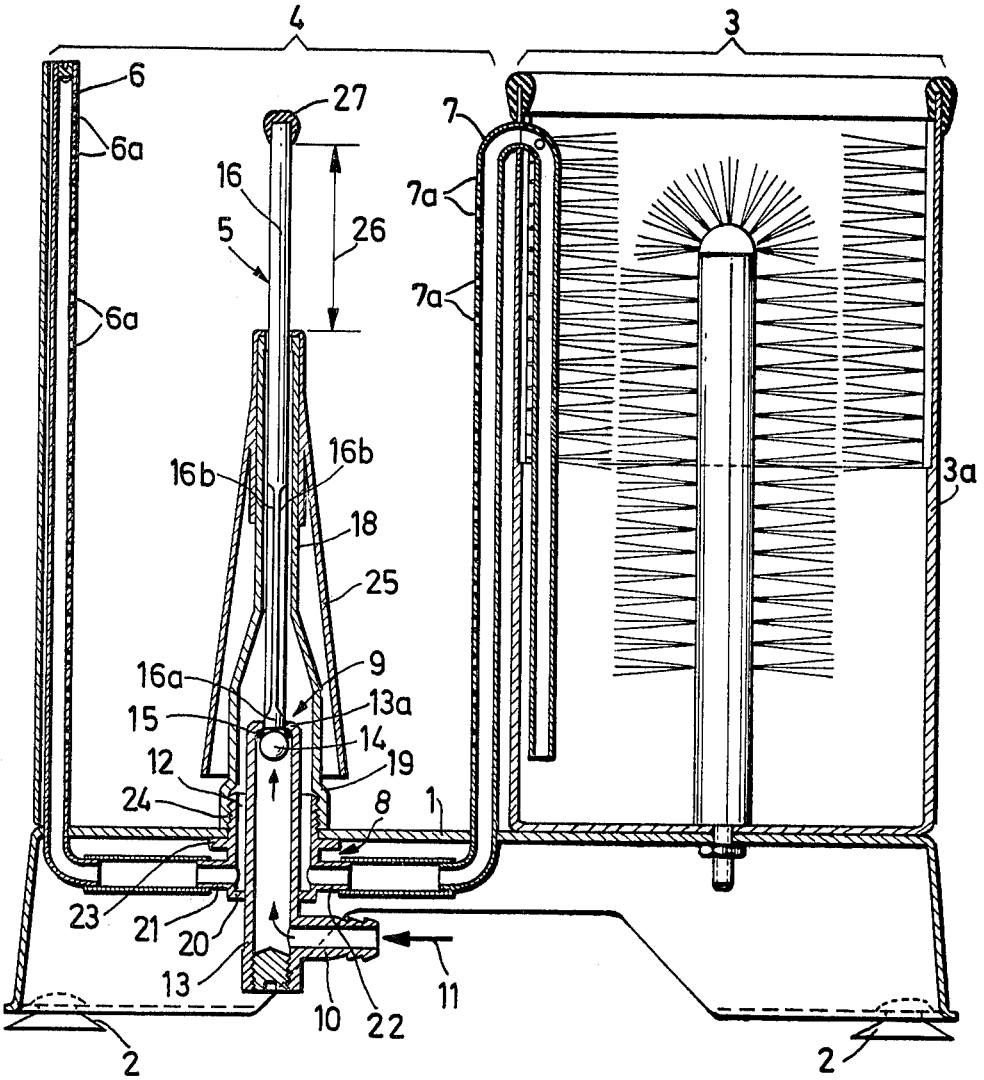
FIG. 1 is a vertical sectional view of an arrangement according to the present invention for use in cleaning containers, especially drinking utensils, of diverse shapes.

Referring now to the drawing in detail, and first to FIG. 1 thereof, it may be seen that the reference numeral 1 has been used to identify a support or a base plate of an arrangement for washing drinking vessels. The base plate 1 is constructed as a bridge and is equipped with suction cups 2. A pre-cleaning or scrubbing device 3 of a conventional construction, and a final cleaning or washing device 4 constructed in accordance with the present invention, are mounted on the base plate 1 next to one another.

The post-cleaning device 4 which is of interest here includes, as one of its main components, a spraying nozzle 5 which extends vertically upwardly from the base plate 1 and which is constructed as a pressure sprayer for the washing of the interior of the respective drinking vessel or container when the latter assumes a predetermined position relative to the base plate 1. The post-cleaning device 4 further includes two tubular jet elements 6 and 7 which are arranged at opposite sides of the spraying nozzle 5, being mounted on a common distributor body 8 with the spraying nozzle or assembly 5. The elements or jet tubes 6 and 7 are provided with a plurality of jet openings 6*a* and 7*a*, respectively, for the washing of the exterior of the respective container assuming the predetermined relative position thereof, the jet openings 6*a* and 7*a* being aimed toward the spraying assembly 5. The distributor body 8 is provided with an upper valve seat 9 for the pressure sprayer 5.

As can further be seen in the drawing, the jet tubes 6 and 7 extend substantially horizontally from the lower or trailing end of the distributor body 8 underneath the base plate 1 to the two sides of the distributor body 8 first, and then substantially vertically upwardly through the base plate 1 at the two opposite sides of the pressure spraying nozzle 5. Additionally, a lateral nipple 10 for the connection of the washing arrangement to the water mains is provided on the distributor body 8, the supply of water to the arrangement being indicated in FIG.1 by the arrow 11.

The pressure sprayer 5 of the post-cleaning device 4 is so constructed as a longitudinal stroke valve that the valve seat 9 is provided at the upper region of the distributor body 8 upwardly of the base plate 1, and that it includes a water flow conducting or diverting arrangement which extends far from the valve seat 9 in the downward direction all the way to underneath the base plate 1 and which includes an annular space 12 for the lateral connection of the jet tubes 6 and 7.

The longitudinal stroke valve is constructed as a ball valve device including a guiding tube or valve body 13 which extends upwardly from the distributor body 8 and passes through the base plate 1, and a valve member of ball 14 which is accommodated in the interior of the valve body 13 for axial displacement therein. The pressure of water supplied from the water mains holds the valve ball 14 in abutment with a sealing ring 15 that is arranged at the upper inwardly upset end 13*a* of the valve body or guiding tube 13, thus keeping the valve in its closed position which is illustrated in FIG. 1.

Figure 2:
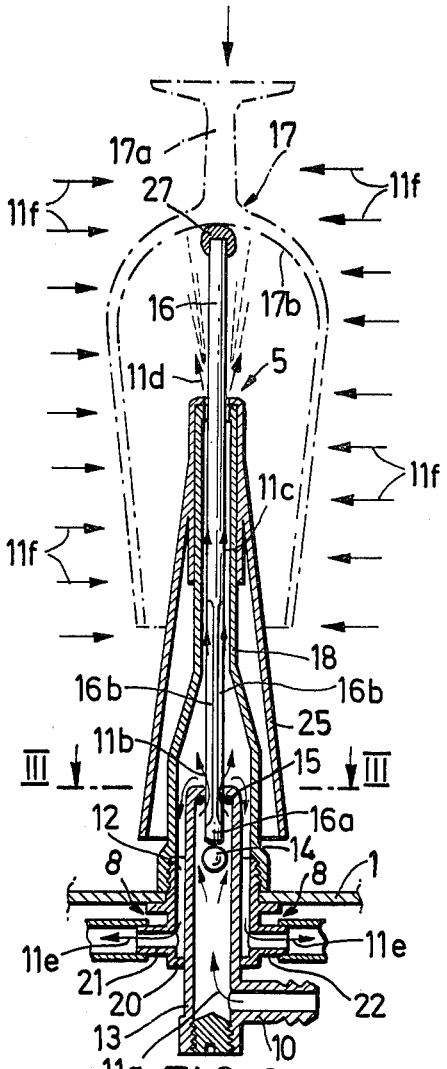
FIG. 2 is a partial sectional view corresponding to that of FIG. 1 and illustrating the principle of operation of the final cleaning device in conjunction with a stemware glass.

The valve ball 14 of the longitudinal stroke valve is loosely acted upon by a valve tappet 16 which is depressed or displaced downwardly during each respective cleaning operation to displace the valve ball 14 into its open position by the bottom wall of the respective container 17 to be washed in the post-cleaning device 4; in FIG. 2, the container 17 is illustrated as having the configuration of a pilsner glass.

The annular space 12 for the connection of the jet tubes 6 and 7 surrounds the guiding tube or valve body 14 for the valve ball 13 which extends upwardly from the distributor body 8. The valve tappet 16 of the longitudinal stroke valve is arranged in the interior of a tubular guiding wall 18 which has an enlarged lower mounting end 19 that adjoins the annular space 12 of the distributor body 8. The distributor body 8 has a connector cup 23 provided with two connecting nipples 21 and 22 for the respective ones of the jet tubes 6 and 7, and a holding flange 23 which is arranged underneath a threaded tubular member 24 that extends through the base plate 1 from below. The holding flange 23 extends substantially radially outwardly from the distributor body 8, and the lower enlarged end 19 of the guiding wall 18 is threaded onto the tubular member 24.

For an additional protection of the drinking utensils or containers 17 from undesirable damage to their rims during the washing or cleaning operation in the final washing device 4, the guiding wall 18 for the valve tappet 16 can be surrounded by a glass protection bell 25 of synthetic plastic material which conically diverges in the downward direction and is open and resiliently yieldable.

Figure 3:
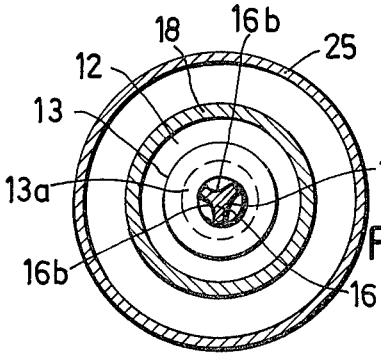
FIG. 3 is a cross-sectional view taken on line III—III of FIG. 2.

As can further be ascertained from the drawing, the valve tappet 16 is made of solid cross section material in the construction of the arrangement of the present invention which is depicted in FIGS. 1 to 3. The valve tappet 16 has a solid cross section foot or trailing end portion 16*a* of a cross-sectionally circular or cylindrical configuration, the foot portion 16*a* substantially completely fills the opening of the ball valve in the position of the valve tappet 16 corresponding to the closed position of the valve ball 14. The valve tappet 16 is then provided with a plurality of, such as with three, longitudinally extending grooves 16*b* which serve for the passage of cleaning liquid or water therethrough at the region of the valve seat 9 in the depressed position of the valve tappet 16 in which it lifts the valve ball 14 off the seat 9. As a result of this configuration, the valve tappet 16 has at the region of the longitudinal grooves 16*b* a substantially star-shaped cross section. The longitudinal grooves 16*b* have a gradually increasing cross-sectional area commencing at the foot portion 16*a*. The grooves 16*b* extend in the longitudinal direction of the valve tappet 16 over a length at least equal to the length of the stroke of the ball valve 13, 14, which is indicated in FIG. 1 by the reference numeral 26 and which substantially corresponds to the length of the stem or foot portion 17*a* of the ordinary or customary pilsner or wine glasses. As a result of the gradually increasing cross sections of the longitudinal grooves 16*b* of the valve tappet 16, sudden pressure pulses or vibrations in the water conduits during the sudden opening of the ball valve 13, 14 can be avoided.

Figure 5:
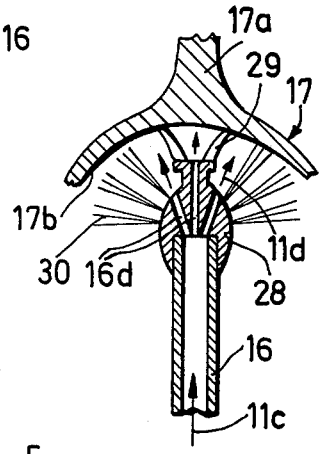
FIG. 5 is a vertical sectional view through a portion of the modification of the inner spraying assembly as revealed in FIG. 4 and showing additional details.
Figure 6:
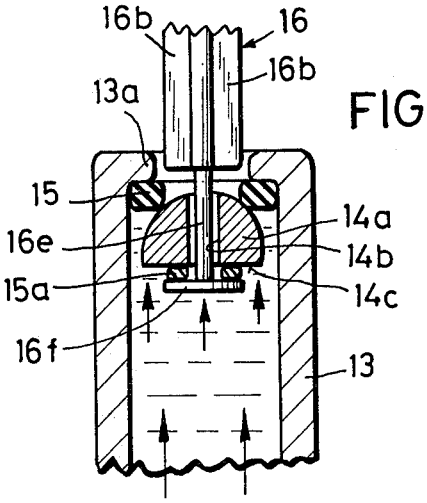
FIG. 6 is a vertical sectional detail view through a modified version of a valve member with a two-stage construction, in a position in which the valve member is closed.

FIGS. 5 and 6 disclose a somewhat modified construction of the washing arrangement 4 and especially of the valve tappet 16. In this construction, the valve tappet 16 has a tubular configuration and is provided, at least over a length corresponding to the stroke length 26, with distributed radially extending openings 16*c*. During the rinsing operation which ensues from the downward displacement of the valve tappet 16 and thus of the valve ball 14, the openings 16*c* become unobstructed one after the other. In this manner, there is obtained even here a gradual increase of the effective flow-through cross sectional area of the passage for the cleaning or rinsing water with increasing degree of downward displacement of the valve tappet 16.

In both of the above-discussed structural modifications, the valve tappet 16 is received in the guiding wall 18 with a radial clearance, so that the rinsing or cleaning water can flow after the opening of the ball valve 13, 14 through the clearance between the valve tappet 16 and the tubular guiding wall 18 and be sprayed against the bottom 17*b* of the container 17 to be cleaned.

Figure 4:
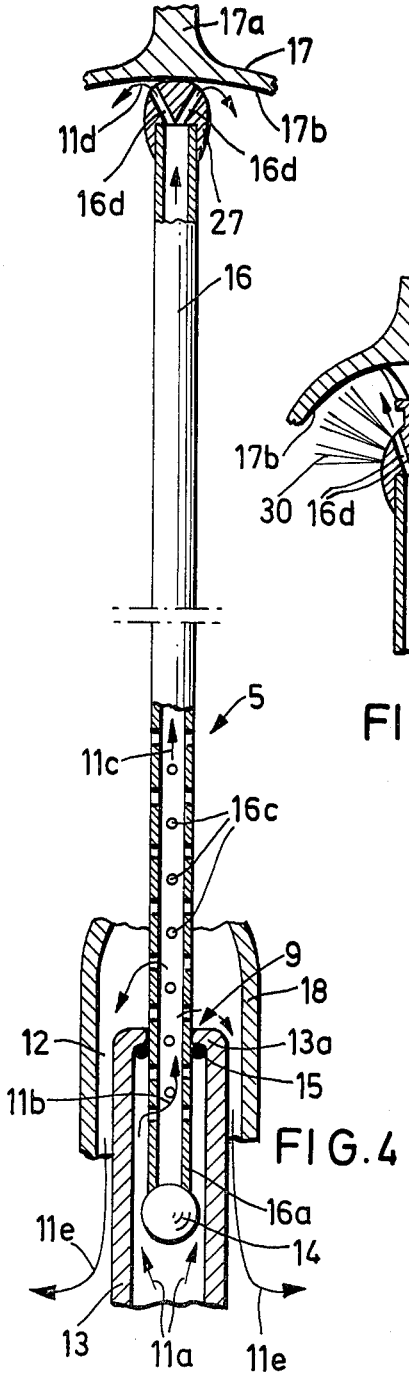
FIG. 4 is a view similar to that of FIG. 2 but showing a modified version of the inner spraying assembly.

However, in the construction illustrated in FIGS. 4 and 5, it is also possible, instead of the cleaning water passage between the valve tappet 16 and the tubular guiding wall 18, to provide the tubular valve tappet 16 at its upper end with one or a plurality of openings 16*d* for the cleaning water. Under these circumstances, instead of a simple abutment cap, which is shown in FIG. 4 at 27 and which includes the openings 27, there may also be used a more complex spraying head 28, as shown in FIG. 5, the spraying head 28 being provided with the spraying openings 16*d*, with a distancing claw 29 and possibly with outwardly extending cleaning bristles 30, and being stationarily mounted on the upper end of the valve tappet 16.

The flow of the cleaning water through and out of the various components of the post-cleaning device 4 is indicated in FIGS. 2 to 5 by arrows 11*a* to 11*f*. Of course, such water flow will only take place when the ball valve 13, 14 is open. In this illustrated construction, the water entering the jet tube 7 also flows into the rinsing vessel 3*a* of the pre-cleaning device 3.

FIGS. 5 to 8 show a further modification of the arrangement 4 in accordance with the present invention, wherein the same reference numerals as before have been used to identify the same or corresponding parts. In this construction, the ball valve arranged at the lower end of the valve tappet 16 is constructed as a two-stage valve and consists of a substantially sperically configurated first valve member 14*a* having a central bore 14*b*, and a substantially plate-shaped second valve member 16*f*. The valve tappet or operating member 16 is provided at its lower end with a downwardly extending substantially pin-shaped extension 16*e* which extends through the bore 14*b* of the first valve member 14 and on which the second valve member 16*f* is mounted. The second valve member 16*f* carries a sealing ring 15*a*. The construction is such that the first valve member 14*a* is supported on the extension 16*e* for movement in the axial direction within a limited range so that, after the valve operating member 16 is depressed, the second valve member 16*f* with its sealing ring 15*a* is first lifted off the flat lower surface 14*c* of the first valve member 14*a* and moves away therefrom in the downward direction, so that it provides access for the pressurized cleaning water to the central bore 14*b* of the first valve member 14*a*, while the first valve member 14*a* still presses against the sealing ring 15 provided at the upper end of the guiding tube 13. The first valve member 14*a* is lifted off the sealing ring 15 only upon further movement of the valve operating member 16 in the downward direction. In this construction, the longitudinally extending grooves 16*b* provided in the valve operating member 16 are open all the way to the end face of the foot or trailing portion of the valve operating member 16, to thereby give the cleaning water an unhindered passage for flow from the central bore 14*b* along the shank of the valve operating member 16.

Figure 7:
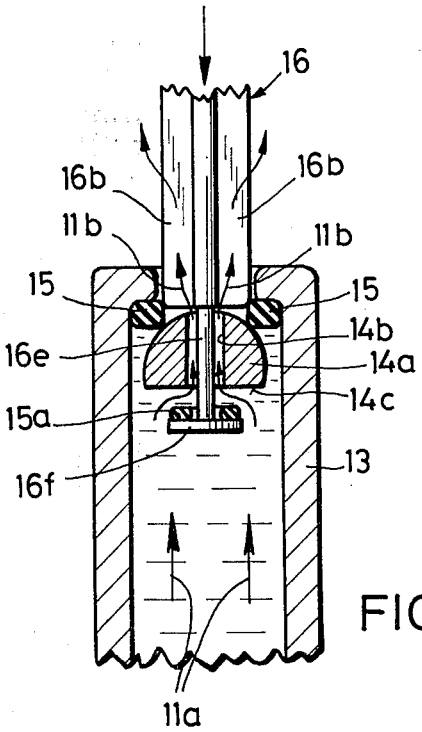
FIG. 7 is a view corresponding to that of FIG. 6 but in a position in which the first stage is open.
Figure 8:
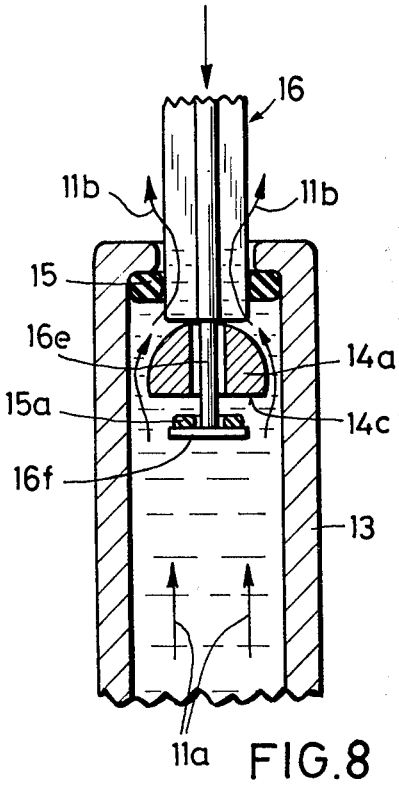
FIG. 8 is a view corresponding to those of FIGS. 6 and 7 but in a position in which the second stage is open as well.

As may best be seen in FIG. 7, upon initial depression of the valve operating member 16, what is released first is the flow of the cleaning water through the central bore 14*b* of the first valve member 14*a* and past the latter to the longitudinal grooves 16*b* provided in the shank of the valve operating member 16. Only at a later stage of the operation or depression of the valve operating member 16 is also the first operating member 14*a* lifted off the valve sealing ring 15, after being engaged by the foot portion of the valve operating member 16. When this occurs, the cleaning water flow takes place as indicated by the arrows 11*b* in FIG. 8 through the annular space existing between the first valve member 14*a* and the valve body 13 to the longitudinal grooves in the valve operating member shank, and through the latter to the spraying nozzles of the spraying assembly 5.

It will be understood that each of the elements described above, or two or more together, may also find a useful application in other types of arrangements differing from the type described above.

While the invention has been illustrated and described as embodied in a post-cleaning device for drinking utensils as constructed for use in bars and similar public establishments, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. An arrangement for cleaning containers, especially drinking utensils of diverse shapes, such as tumblers and stemware, comprising a support; means for spraying cleaning liquid on the internal surface of the respective container assuming a predetermined position relative to said support, including an elongated spraying assembly mounted on said support and having an internal distributing passage spaced in a predetermined direction from said support, and means for controlledly admitting the cleaning liquid at a predetermined pressure into said distributing passage, including a valve seat situated within said spraying assembly immediately upstream of said distributing passage, and a valve member movable toward and away from said valve seat; and means for directing a plurality of jets of the cleaning liquid against the external surface of the container assuming its predetermined relative position, including at least one tubular element extending substantially parallel to said direction at a transverse spacing from said spraying assembly and having a plurality of jet openings aimed toward said spraying assembly, and means for conducting a portion of the cleaning liquid from said distributing passage substantially oppositely to said direction to an upstream portion of said tubular element.

2. The arrangement as defined in claim 1, wherein said spraying assembly includes a tubular guiding member mounted on and extending in said direction from said support; wherein said valve seat is arranged within said guiding member at a location remote from said support; wherein said valve member is accommodated in said guiding member for movement in and opposite to said direction; and wherein said controlledly admitting means further includes a valve tappet mounted in said spray assembly for movement in and opposite to said direction and operatively connected to said valve member for moving the latter at least away from said valve seat.

3. The arrangement as defined in claim 2, wherein said valve member has a spherical configuration.

4. The arrangement as defined in claim 3, wherein said conducting means includes means for bounding an annular space surrounding said guiding member at said support and communicating with said upstream end of said tubular element.

5. The arrangement as defined in claim 4, wherein said bounding means includes an annular bounding wall having a substantially radially extending connecting nipple for said tubular element at its trailing end as considered in said direction.

6. The arrangement as defined in claim 5, wherein said conducting means further includes a confining wall merging with and extending in said direction from said bounding wall to surround a distributing space around a portion of said distributing passage, and a tubular guiding wall extending beyond said confining wall as considered in said direction; and wherein said valve tappet is partially received and guided in said guiding wall.

7. The arrangement as defined in claim 6, wherein said support includes a plate-shaped support portion; wherein said bounding wall includes a mounting portion constituting said trailend and having said connecting nipple, a holding flange abutting said support portion, and an externally threaded portion extending in said direction beyond said support portion, and another portion integral with said confining wall and having an internal thread engaging said external thread of said mounting portion.

8. The arrangement as defined in claim 6, wherein said valve tappet is elongated in said direction and has a solid cross section at least at the region adjacent said valve member and at least one longitudinally extending groove for the passage of the cleaning liquid therethrough at least past said valve seat when said valve tappet holds said valve member away from said valve seat.

9. The arrangement as defined in claim 8, wherein said groove has a cross section which gradually increases from the region of solid cross section adjoining said valve member.

10. The arrangement as defined in claim 6, wherein said valve tappet is tubular and has a plurality of orifices for the passage of the cleaning fluid therethrough into the interior of said valve tappet, said orifices extending substantially radially and being distributed over the length of said valve tappet, so that the effective area for the passage of the cleaning fluid increases with increasing distance of said valve member from said valve seat.

11. The arrangement as defined in claim 6, wherein said valve tappet is received in said guiding wall with a radial clearance therefrom at least over a part of its periphery to form an annular clearance between itself and said guiding wall for the flow of the cleaning liquid therethrough toward the bottom of the respective container assuming its predetermined relative position.

12. The arrangement as defined in claim 6, wherein said valve tappet is tubular to form a flow passage for the cleaning liquid therethrough from a trailing end to a leading end of said valve tappet as considered in said direction; and wherein said valve tappet has at its leading end at least one aperture communicating with said flow passage and aimed at the container assuming its predetermined relative position to form a spray directed against the latter.

13. The arrangement as defined in claim 2, wherein said valve member is constructed as a two-stage valve member.

14. The arrangement as defined in claim 13, wherein said controlledly admitting means further comprises a valve operating member mounted in said spray assembly for movement in and opposite to said direction and having a portion of predetermined transverse cross section extending beyond said valve seat as considered opposite to said direction; and wherein said two-stage valve member includes a substantially spherical first valve element closer to said valve seat and having a central passage receiving said portion of said valve operating member and having a transverse cross section exceeding that of the latter to form an annular flow passage therewith, and a substantially plate-shaped second valve element rigidly connected to said valve operating member for movement therewith and situated to the other side of said first valve element from said valve seat, said valve elements so cooperating with one another and with said valve seat that initially only said second valve element is lifted during an opening operation off said first valve element thus permitting the cleaning liquid to flow through said annular flow passage in said first valve element, followed by lifting of said first valve element off said valve seat only upon considerable movement of said valve operating member opposite to said direction.

* * * * *